US007997517B2

(12) United States Patent
Melo et al.

(10) Patent No.: US 7,997,517 B2
(45) Date of Patent: Aug. 16, 2011

(54) CUSHIONING ELEMENT FOR MILL LINER

(75) Inventors: Ricardo Abarca Melo, Santiago (CL); Ricardo Fernandez Daberti, Santiago (CL)

(73) Assignee: Vulco, S.A. (CL)

( * ) Notice: Subject to any disclaimer, the term of this patent is extended or adjusted under 35 U.S.C. 154(b) by 432 days.

(21) Appl. No.: 11/795,655

(22) PCT Filed: Jan. 16, 2006

(86) PCT No.: PCT/AU2006/000048

§ 371 (c)(1),
(2), (4) Date: Apr. 8, 2008

(87) PCT Pub. No.: WO2006/076763

PCT Pub. Date: Jul. 27, 2006

(65) Prior Publication Data

US 2009/0065618 A1 Mar. 12, 2009

(30) Foreign Application Priority Data

Jan. 18, 2005 (CL) ..... 101-2005

(51) Int. Cl.
*B02C 17/22* (2006.01)

(52) U.S. Cl. ..... 241/182; 241/300

(58) Field of Classification Search ..... 241/182, 241/183, 300, DIG. 30
See application file for complete search history.

(56) References Cited

U.S. PATENT DOCUMENTS

| | | | | | |
|---|---|---|---|---|---|
| 3,107,867 | A | * | 10/1963 | Svensson et al. | 241/102 |
| 3,607,606 | A | * | 9/1971 | Beninga | 428/67 |
| 3,942,239 | A | * | 3/1976 | Johansson | 29/462 |
| 4,029,354 | A | * | 6/1977 | Valeri | 296/39.2 |
| 4,177,955 | A | * | 12/1979 | Miller | 241/183 |

FOREIGN PATENT DOCUMENTS

| | | |
|---|---|---|
| SU | 950 436 | 8/1982 |
| SU | 1235 527 A | 6/1986 |
| SU | 1625527 A | 2/1991 |

* cited by examiner

*Primary Examiner* — Faye Francis
(74) *Attorney, Agent, or Firm* — Morriss O'Bryant Compagni

(57) ABSTRACT

A cushioning element suitable for use in a liner assembly for a grinding mill, the liner assembly including a mounting element having a recess therein, the cushioning element being located within the recess, and a wear element operatively connected to the cushioning element, the cushioning element including a cushion body of elastomeric material including a side section and opposed end sections, a plurality of cavities within the cushion body and extending from at least one of the end sections towards the other end section.

11 Claims, 1 Drawing Sheet

CUSHIONING ELEMENT FOR MILL LINER

BACKGROUND

1. Field of Invention

The present invention relates generally to the crushing, grinding, comminuting or similarly processing of materials such as mineral ores, rock and the like, and more particularly to apparatus for use in such processing.

2. Description of Related Art

Grinding mills are one form of apparatus used for processing materials as described above. Typical grinding mills are generally comprised of a drum shaped shell mounted for rotation about its central axis. The axis of the shell is generally horizontally disposed or slightly inclined towards one end. The interior of the shell forms a treatment chamber into which the material to be processed is fed. In one form of mill a grinding medium such as balls or rods is placed in the treatment chamber with the material to be processed. During rotation of the shell the grinding medium impacts on the material under the effects of gravity to cause the crushing or grinding action. The grinding medium and material to be processed are carried up the side of the shell whereafter it falls to the bottom of the shell. To assist in lifting the material up the side of the shell lifter bars are often provided which are secured to the interior surface of the shell. The lifter bars extend generally longitudinally of the shell and are circumferentially spaced apart around the inner surface.

In order to protect the inner surfaces of the shell from damage during the grinding process, liners are often provided on the inner surface of the shell. These liners take many forms. FIGS. 1 and 2 of the specification illustrate one conventional form of liner assembly. The liner assembly generally indicated at 10 comprises a mounting element 12 having a base wall 13 and a sidewall 14 forming a recess 15 with an open side which receives a cushioning element 16 therein. A wear element 18 is fitted for example by chemical bonding to the cushioning element 16. The base wall 13 of the mounting element 12 is adapted to be secured to the inner face of the shell by fastening bolts.

The elastomeric cushion's main purpose is to absorb and disperse impact forces which arise as a result of wear elements being struck by the grinding medium and the material being processed inside the shell as it rotates. As best seen in FIG. 2, due to the configuration of the mounting element 12, lateral deformation of the elastomeric cushion is restricted and as such its deflection D resulting from the application of an impacting force FI to the wear element is limited to the vertical direction and its ability to absorb or disperse the impact energy is significantly reduced. This results in a shorter useful life for the wear elements.

BRIEF SUMMARY OF THE INVENTION

It is an object of the present invention to provide an arrangement which alleviates the aforementioned problem.

According to one aspect of the present invention there is provided a cushioning element suitable for use in a liner assembly for a grinding mill, the liner assembly including a mounting element having a recess therein, the cushioning element when in use being located within the recess, and a wear element operatively connected to the cushioning element, the cushioning element including a cushion body of elastomeric material including a side section and opposed end sections, a plurality of cavities within the cushion body and extending from at least one of the end sections towards the other end section.

Preferably the cavities extend through the cushioning body between and open into the end sections.

The cross-sectional shape of the cavities may be of any suitable form. For example, the cross-sectional shape of the cavities may be generally polygonal, generally circular, generally quadrilateral, such as square or rectangular, or generally polyhedral. The cavity side walls may be straight, curved or a combination of the above or any other suitable shape.

In one form the cavities are generally all the same shape and size. In another form the cavities are generally all the same shape but of different sizes. In yet another form the cavities are all generally different shapes and sizes.

Preferably the total volume of the cavities is between 30% and 70% of the total volume of the cushion body.

Preferably the addition of the total cavity perimeters of the surface of cushion is between 1 to 5 times the external perimeter of the upper side of the cushion element.

According to another aspect of the present invention there is provided a liner assembly as described above in its broad or more limited forms.

Preferred embodiments of the invention will hereinafter be described with reference to the accompanying drawings.

DETAILED DESCRIPTION OF THE INVENTION

Figure 1:
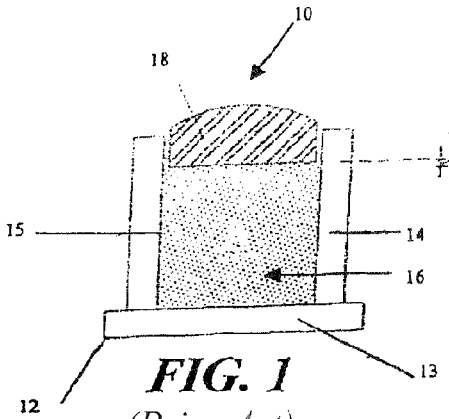
FIG. 1 (Prior Art)
FIG. 1 is a schematic cross-sectional view of a conventional liner assembly.
Figure 2:
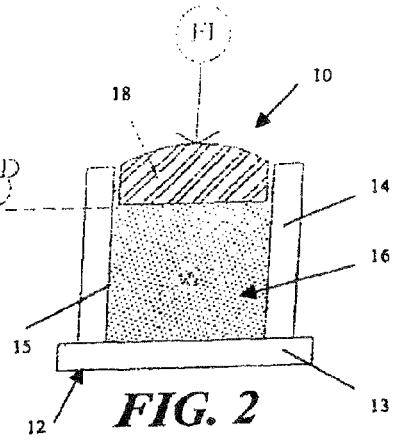
FIG. 2 (Prior Art)
FIG. 2 is a similar view to that of FIG. No. 1 illustrating the effect of an impact force on the assembly.

A description of the conventional liner assembly shown in FIG. Nos. 1 and 2 has already been provided above by reference to FIGS. 1 and 2.

Figure 3:
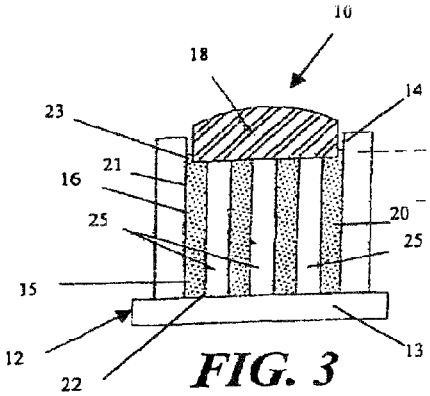
FIG. 3 is a schematic cross-sectional view of a liner assembly including a cushioning element according to a preferred embodiment of the present invention.
Figure 4:
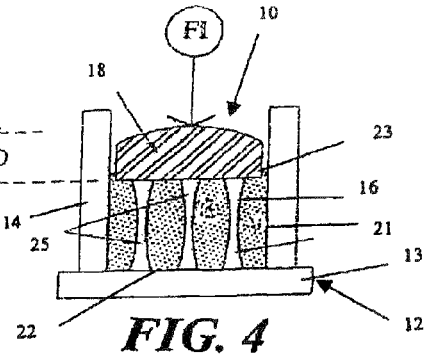
FIG. 4 is a similar view to that of FIG. 3 illustrating the effect of an impact force on the assembly.
Figure 5:
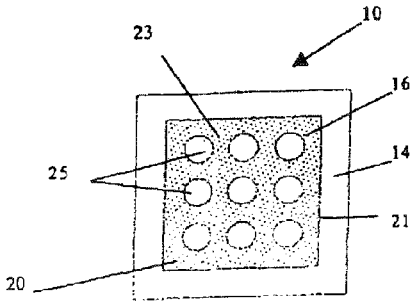
FIGS. 5 and 6 are plan views of different liner assemblies having cushioning elements according' to the invention.

The liner assembly 10 shown in FIGS. 3 and 4 includes a mounting element 12 having a base wall 13 and a side wall 14 forming a recess 15. As described previously the mounting element is adapted to be secured to the inner surface of the shell. A cushioning element 16 according to the present invention is positioned within the recess 15 and a wear element 18 is secured to the cushioning element 16. Preferably a plurality of liner assemblies are fitted to the inner surface of the shell in a selected configuration.

As shown in FIG. 3 the cushioning element 16 includes a cushion body 20 having a side wall 21 and end walls 22 and 23. The cushioning element further includes a plurality of cavities 25 within the body 20 and spaced from the side wall 21 the cavities extending through the body between the end walls 22 and 23.

As shown in FIG. 4, under the effect of an impact force FI on wear element 18 the cavities 25 permit lateral displacement of the cushioning element 16 and thereby increasing the ability of the arrangement to deflect vertically (deflection D) thereby increasing the dispersement of energy caused by the impact force F1.

The shape of the inner wall of the cavities may be flat, concave, convex or a combination thereof. As shown in FIG.

Figure 6:
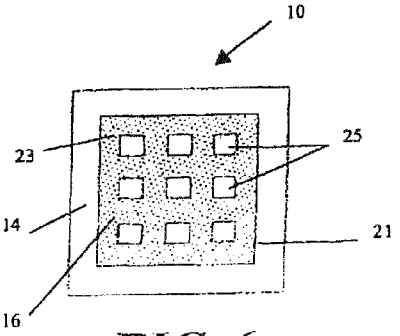

5 the cavities 25 are circular in cross-section and arranged in rows. As shown in FIG. 6 the cavities 25 are square in cross-section.

Finally, it is to be understood that various alterations, modifications and/or additions may be incorporated into the various constructions and arrangements of parts without departing from the spirit or ambit of the invention.

The invention claimed is:

1. A liner assembly for a grinding mill, the grinding mill including a drum shaped shell having an inner surface, the shell being mounted for rotation about its central axis, the liner assembly including a mounting element having a base wall for securement to an inner surface of a grinding mill drum, a continuous upstanding side wall and an open end defining a recess therein, said recess extending from said open end towards said base wall, a cushioning element located within the recess, and a wear element operatively connected to the cushioning element, wherein the cushioning element includes a cushion body of elastomeric material having a continuous side section and opposed end sections, one of the end sections being positioned adjacent the base wall of the mounting element, and a plurality of cavities within the cushion body extending from at least one of the opposed end sections towards the other end section.

2. A liner assembly according to claim 1 wherein the cavities extend through the cushioning body between the end sections.

3. A liner assembly according to claim 1 wherein the cross-sectional shape of the cavities is generally polygonal.

4. A liner assembly according to claim 1 wherein the cross-sectional shape of the cavities is generally circular.

5. A liner assembly according to claim 1 wherein the cross-sectional shape of the cavities is generally quadrilateral.

6. A liner assembly according to claim 1 wherein the cross-sectional shape of the cavities is generally polyhedral.

7. A liner assembly according to claim 1 wherein the cavities are generally all the same shape and size.

8. A liner assembly according to claim 1 wherein the cavities are generally all the same shape but have different sizes.

9. A liner assembly according to claim 1 wherein the cavities are generally of different shapes and sizes.

10. A liner assembly according to claim 1 wherein the total volume of the cavities is between 30% and 70% of the total volume of the cushion body.

11. A liner assembly according to claim 1 wherein each said plurality of cavities has a perimeter and the addition of the total cavity perimeters of the surface of the cushion body is between 1 to 5 times the external perimeter of the upper side of the cushioning element.

* * * * *